United States Patent [19]

Kötting et al.

[11] Patent Number: 4,837,978

[45] Date of Patent: Jun. 13, 1989

[54] MACHINE FOR GRINDING THE EDGES OF LENSES

[75] Inventors: Fritz Kötting, Dormagen; Günter Barwasser, Neuss, both of Fed. Rep. of Germany

[73] Assignee: Wernicke & Co. GmbH, Düsseldorf, Fed. Rep. of Germany

[21] Appl. No.: 90,164

[22] Filed: Aug. 27, 1987

[30] Foreign Application Priority Data

Aug. 28, 1986 [DE] Fed. Rep. of Germany ..... 3629252

[51] Int. Cl.[4] ..... B24B 17/02

[52] U.S. Cl. ..... 51/101 LG; 51/97 NC; 51/165.75; 51/284 E

[58] Field of Search ..... 51/50 R, 50 PC, 97 NC, 51/97 R, 95 R, 101 LG, 284 E

[56] References Cited

U.S. PATENT DOCUMENTS

| | | | |
|---|---|---|---|
| 3,894,361 | 7/1975 | Georgiadis et al. | 51/101 LG |
| 4,176,498 | 12/1979 | Vulich et al. | 51/101 LG |
| 4,383,393 | 5/1983 | Takubo | 51/101 LG |
| 4,512,108 | 4/1985 | Kobayashi | 51/101 LG |
| 4,596,091 | 6/1986 | Daboudet | 51/101 LG |

FOREIGN PATENT DOCUMENTS

| | | | |
|---|---|---|---|
| 1627984 | 9/1973 | Fed. Rep. of Germany . | |
| 3221713 | 12/1983 | Fed. Rep. of Germany . | |
| 2481635 | 11/1981 | France | 51/101 LG |
| 2041800 | 9/1980 | United Kingdom | 51/101 LG |

*Primary Examiner*—Robert P. Olszewski

*Attorney, Agent, or Firm*—Becker & Becker, Inc.

[57] ABSTRACT

A machine for grinding the edges of a lens via a set of different grinding wheels for rough and finish grinding of the lens. The machine includes a machine housing, a holding element mounted in the housing for holding either the lens or the set of grinding wheels and movable in two directions relative to the other, with these directions being at right angles to one another, a support element provided on the housing, and a toothed-wheel gearing for effecting the movement of the holding element, and hence of the lens or set of grinding wheels disposed thereon, in one of the two directions, with this gearing including a toothed rack on the holding element, and a driven pinion on the support element, with the pinion being coaxially mounted on the support element along with a drive motor, a coupling, and a potentiometer.

9 Claims, 2 Drawing Sheets

MACHINE FOR GRINDING THE EDGES OF LENSES

BACKGROUND OF THE INVENTION

The present invention relates to a machine for grinding the edges of a lens, such as a spectacle lens, via a set of different grinding wheels for rough and final or finish grinding of lenses.

The published French application No. 24 81 635. Asselin dated Nov. 6, 1981; describes a machine for grinding the edges of lenses where an arm that carries the spectacle lens can be axially adjusted via a pinion that meshes with a rack or the like; a potentiometer detects this axial adjustment.

German Patent No. 1 627 984. Asselin et al dated Sept. 27, 1973; furthermore discloses a machine for grinding the edges of lenses that has an arm which is pivotable about a horizontal axis and on which the spectacle lens is held. The axial movement of the arm is effected by a motor via a friction drive. However, the axial adjustment of the arm can be undertaken only in a certain position relative to the friction wheel, which is mounted on the drive shaft of the motor. German Offenlegungsschrift No. 32 21 713 Kotting et al dated Dec. 15, 1983 as basis for U.S. Pat. No. 4,637,168-Kotting et al dated Jan. 20, 1987, each belonging to the assignee of the present invention, and U.S. Pat. No. 4,176,498, Vulich et al dated Dec. 4, 1979 disclose machines for grinding the edges of lenses where the different grinding wheels for rough and finish grinding are disposed on a carriage that can be adjusted in two horizontal coordinates relative to the lens that is to be ground, and the template thereof.

In contrast to these heretofore known machines for grinding the edges of lenses, it is an object of the present invention to provide a structurally simpler machine, and to provide for a more precise adjustment of the grinding wheels relative to the lens or of the lens relative to the grinding wheels without additional means; the apparatus for axially adjusting the arm or the support element that is provided with the grinding wheels can be mounted as a unit on the machine housing, with this requiring little extra work.

BRIEF DESCRIPTION OF THE DRAWINGS

These and other objects of the present invention will appear more clearly from the following specification in conjunction with the accompanying schematic drawings, in which.

SUMMARY OF THE INVENTION

Figure 1:
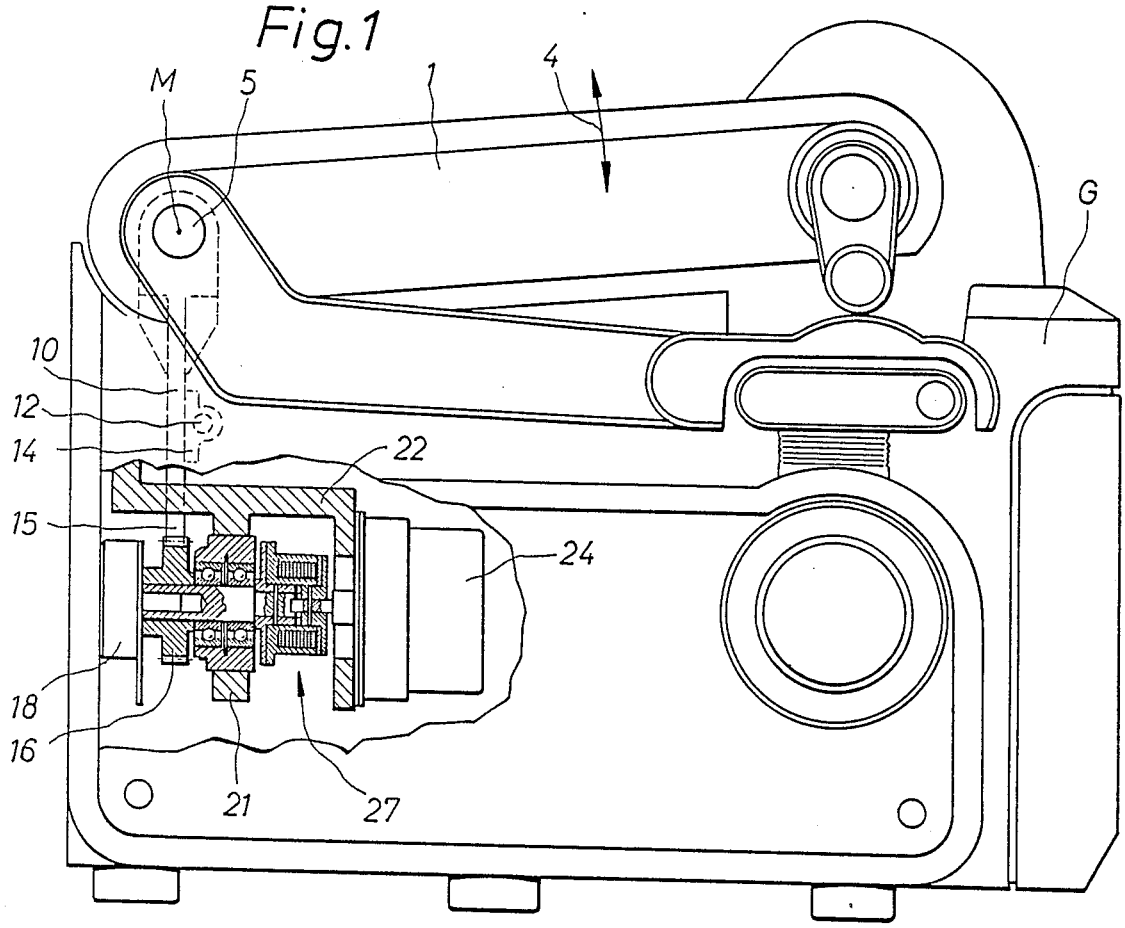
FIG. 1 is a partially sectioned side view of a first exemplary embodiment of the inventive machine, and shows an adjustable arm.

Pursuant to a first embodiment of the inventive machine for grinding the edges of a lens, the machine includes a machine housing that has a longitudinal direction and in which are mounted a set of the different grinding wheels, with the machine further comprising: a horizontal shaft that is mounted on the machine housing and is parallel to, and displaceable in, said longitudinal direction thereof; an arm that carries the lens and is pivotably mounted on the horizontal shaft in such a way as to be displaceable in said longitudinal direction of the machine housing along with the horizontal shaft; a bridge that is mounted in the machine housing in such a way as to be displaceable in said longitudinal direction thereof, with the bridge being connected to the horizontal shaft in such a way that the latter is pivotable relative thereto and is displaceable along with the bridge, thus also displacing the arm; a support element provided on the machine housing; a motor mounted on the support element; a coupling mounted on the support element and operatively connected to the motor; a toothed-wheel gearing for effecting the longitudinal displacement of the bridge, and hence of the horizontal shaft and the arm, with this gearing including a toothed rack disposed on the bridge and a pinion that is mounted on the support element and is operatively connected to the coupling; and a potentiometer that is mounted on the support element and is in engagement with the gearing, whereby the motor, coupling, potentiometer, and pinion are coaxially disposed on the support element.

Pursuant to a second embodiment of the inventive machine for grinding the edges of a lens, the machine comprises: a bridge-like support frame that is movable in two horizontal coordinates; a first motor mounted on the support frame and having a shaft on which is mounted a set of different grinding wheels; a movable mounting base for supporting the support frame in such a way that said aforementioned movement thereof is possible; and a toothed rack that is provided on the support frame and meshes with a pinion that is coaxially mounted on the mounting base along with a drive motor, a potentiometer, and a coupling that is disposed between the drive motor and the pinion.

The use of a toothed rack and a pinion guarantees the precise positioning of the arm or of the support member on the mounting base, with care being taken that the pinion can mesh in a slip-free manner with the toothed rack. An extension of a tensioning member or the like is eliminated, so that a time-consuming mounting of such a member is no longer necessary. The adjusting motor, the coupling, the pinion, and the potentiometer are coaxially disposed on a common support element that is secured in the machine housing. The assembly, mounting, and setting of the components relative to one another can be effected outside the machine housing, so that it is then merely necessary to mount the support element, along with the components disposed thereon, in the machine housing.

Further specific features of the present invention will be described in detail subsequently.

DESCRIPTION OF PREFERRED EMBODIMENTS

Figure 2:
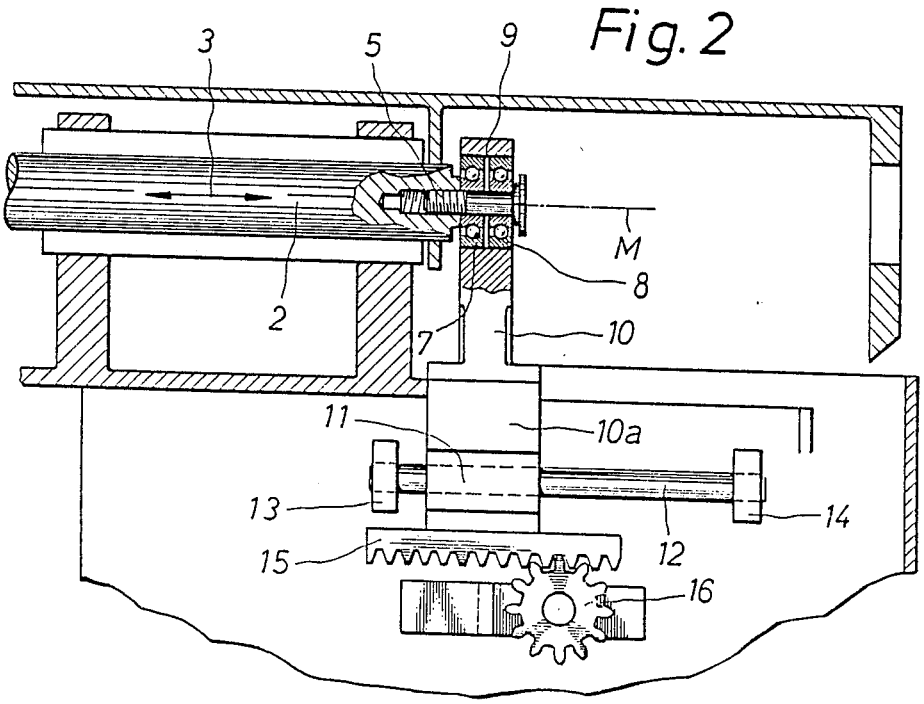
FIG. 2 is a view of the adjustment apparatus for the arm of FIG. 1.
Figure 3:
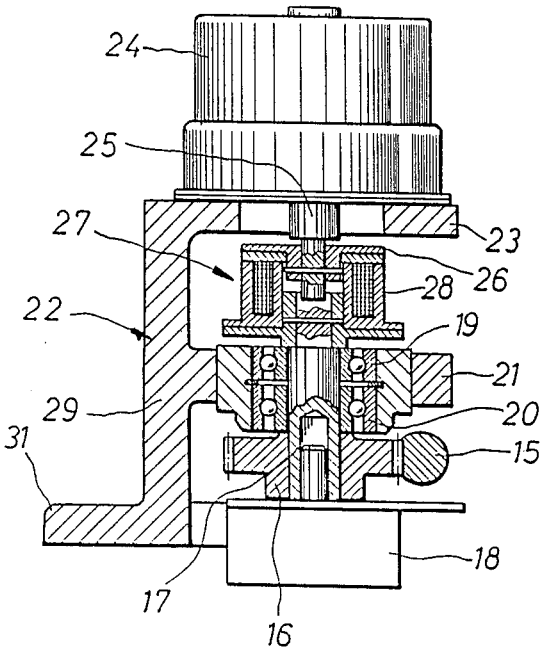
FIG. 3 is a view that shows the drive motor, the coupling, the pinion and toothed rod, and the potentiometer on a support means that is to be mounted in the machine housing.

Referring now to the drawings in detail, in the embodiment shown in FIGS. 1 to 3, the shaft 2 is mounted on the housing G of the machine, in which the grinding wheels are disposed, in such a way as to be longitudinally adjustable in the axial direction (arrow 3 in FIG. 2). The arm 1 that carries the spectacle lens is secured to the shaft 2 as an upper part of the machine. The arm 1 can be pivoted between a position in which the spectacle glass is disposed above the grinding wheels, and a position in which the spectacle lens is machined on the grinding wheels. It is also possible to have a configuration other than that where the arm 1 that holds the lens between two lens holding shafts is an upper machine part.

In one end of the shaft 2, in the central axis M thereof about which the arm 1 pivots, there is tightly screwed in one end of a pin 5 that is surrounded by two bearings 7, 8. These bearings are received by a bore 9 of a bridge 10 in such a way that the arm 1 can be pivoted relative to the shaft 2 in the direction of the double arrow 4 of FIG. 1.

The portion 10*a* of the bridge 10 is provided with a guide sleeve 11 that extends parallel to the shaft 2. A shaft 12 extends through the guide sleeve 11, with the ends of the shaft 12 being connected to a wall of the housing with the aid of brackets 13, 14 or the like. In this way, the bridge 10, when it is adjusted along with the shaft 2 in the direction of the arrow 3, is precisely guided and always maintains its vertical position.

A toothed rack 15 is secured to the bottom of the bridge 10, with the teeth of the rack 15 extending downwardly and meshing with a pinion 16 that is disposed below the rack 15. Together with the subsequently-to-be-described parts, the pinion 16 forms the drive or adjustment apparatus for the axial movement of the shaft 2 and the arm 1, together with the lens, disposed thereon. The pinion 16 is disposed on a shaft 17 (FIG. 3), the free end of which carries the rotatable portion of a control or potentiometer 18 that is suitably accommodated in the machine housing.

The shaft 17 is supported by two bearings 19, 20, which are disposed in a flange 21 of a support element 22. The latter carries the potentiometer 18 and is provided with a second flange 23 that is directed parallel to the flange 21. A motor 24 is fixedly secured to that side of the flange 23 that is remote from the potentiometer 18 and the pinion 16. The shaft 25 of the motor 24 carries the armature 26 of an electromagnetic coupling 27, the coil 28 of which is disposed concentric to the shafts 17, 25. The armature 26 of the electromagnet is connected to the shaft 25, while the core of the coil 28 is connected to the shaft 17.

The leg 29 of the support element 22 is provided with a mounting flange 31, with the aid of which the entire drive and adjustment apparatus of the arm 1 can be secured in a single operation to a wall of the housing. Care is taken outside the housing that the pinion 16 meshes free of play with the teeth of the rack 15. As a result of this play-free engagement of the pinion with the toothed rack, an exact positioning of the arm 1 is assured when the motor is not running or when the electromagnetic coupling is disengaged.

Figure 4:
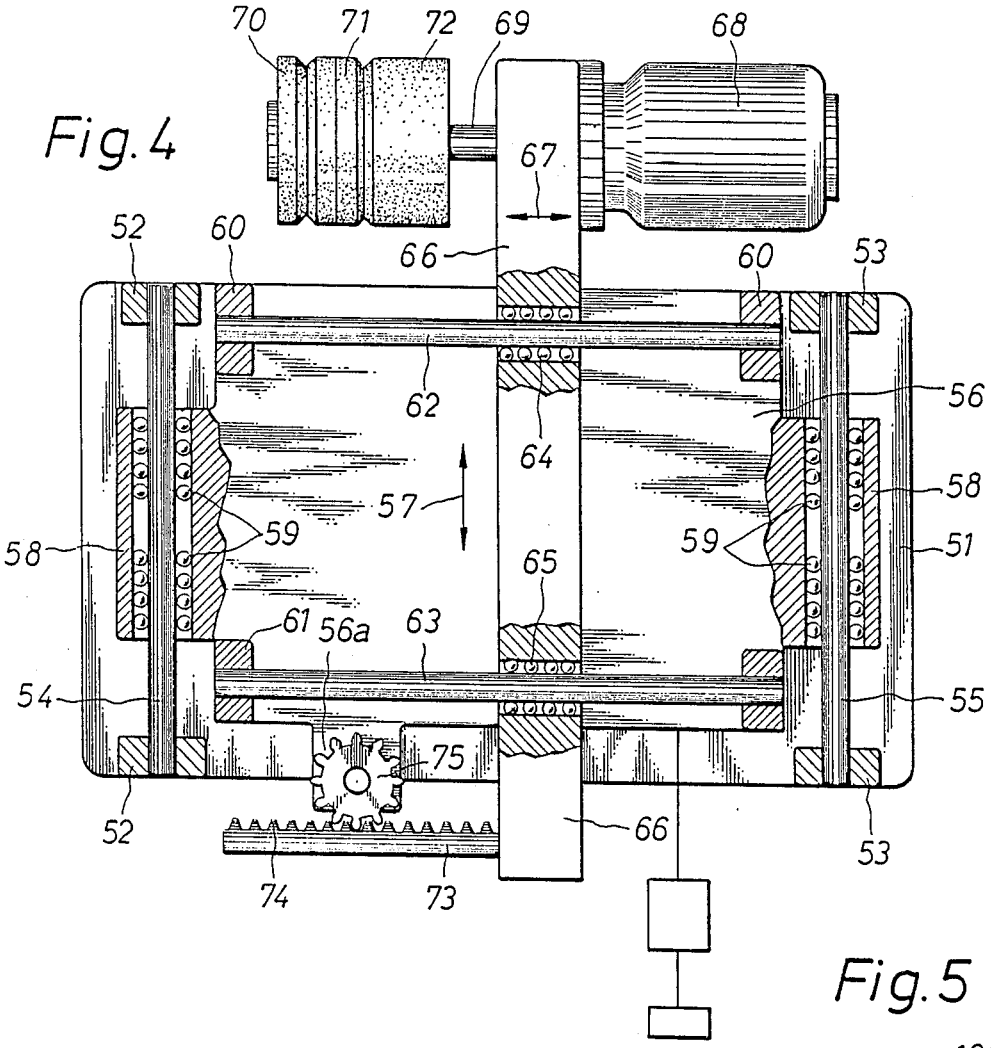
FIG. 4 is a partially sectioned plan view of a second exemplary embodiment of the inventive machine, and shows a support frame, which is adjustable in two horizontal coordinate directions on a mounting base, with the grinding wheels and the drive motor that turns them being disposed on the support frame.

In the embodiment illustrated in FIG. 4, the plate of frame 51 on the machine housing is provided with four small bearing blocks 52, 53 that, in pairs, are disposed coaxially. Two guide rods 54, 55 can be inserted through the bearing blocks 52, 53 and can be secured therein. Between the small bearings blocks 52 on the one hand and 53 on the other hand, it it therefore possible to adjust a mounting base 56 on the guide rods 54, 55 in the direction of the double arrow 57. For this purpose, the mounting base 56 is provided with two brackets 58 having bearings 59, with the guide rods 54, 55 being guided through the latter.

At or near its corners, the mounting base 56 is provided with pairs of small blocks 60, 61 through which are inserted guide rods 62, 63 that are then secured in the blocks. With the aid of the bearings 64, 65, a bridge-like support frame 66 is adjustable on the guide rods 62, 63 in the direction of the double arrow 67. One free end of the support frame 66 has securely flanged thereto a motor 68, the shaft 69 of which extends through the bridge-like support frame 66 and, at that end thereof remote from the motor 68, carries the various grinding wheels 70, 71, 72.

That end of the bridge-like support frame 66 remote from the motor 68 and the grinding wheels 70 to 72 has securely connected thereto a toothed rack 73, the toothed portion 74 of which faces the guide rod 63. The mounting base 56 is provided with an extension 56*a* which, on a non-illustrated support frame, is provided with an apparatus that corresponds to the drive and adjustment apparatus of FIG. 3. The extension 56*a* is also provided with a pinion 75 that again meshes with the toothed rack 73 in a manner free of play.

It the apparatus of FIG. 4, the grinding wheeels 70 to 72 can be adjusted in the direction of the arrow 67 relative to the spectacle lens, which cannot be moved in the longitudinal direction.

With the aid of the potentiometer, the precise position of the spectacle lens relative to the grinding wheels, or of the grinding wheels 70 to 72 of FIG. 4 relative to the spectacle lens, can be determined or set.

The electromagnetic coupling 27 serves as a break, so that for the rough grinding, the drive motor 24, 68 is stopped, and the electromagnetic coupling is switched on, so that the arm 1, or the grinding wheel unit on the support frame 66, is held securely in place in the axial direction. For axially translating the arm 1, or for longitudinally adjusting the support frame 66, into a preselected grinding wheel position, for example for placing the lens in a bevelled groove, the electromagnetic coupling 27 is switched on and the motor 24 or 28 is also started, so that the pinion 16 or 75 is rotated and an axial movement is imparted to the toothed rack 15 or 73.

If one wants to allow the edge of the spectacle lens to be guided freely by the bevelled groove, the motor 24 and the electromagnetic coupling 27 are turned off, so that the arm 1, and analogously the support frame 66 with the grinding wheel unit, can move freely in the axial direction. If the spectacle lens or the grinding wheels 70 to 72 are not supposed to carry out any axial movement during the grinding, the components assume a position similar to that assumed during rough grinding.

Figure 5:
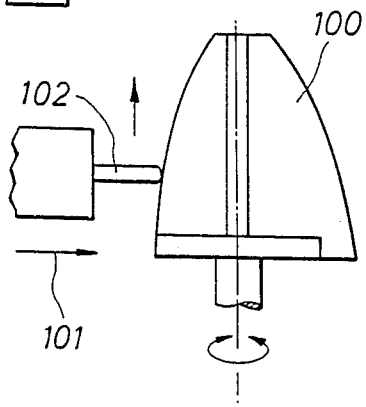
FIG. 5 is a view that shows the positive or automatic guidance of the arm or of the bridge-like support frame with the grinding wheels and the motor therefore.

If a bevelling is to be effected accompanied by positive or automatic guidance of the arm 1 or of the bridge-like support frame 66, a dome-like control template or cam 100 is used (FIG. 5). For this purpose, the motor 24 and the electromagnetic coupling 27 are turned on, so that the arm 1 or the support frame 66 is resiliently pressed against the control template 100 in the direction of the arrow 101, with a slip between the motor shaft 25 and the pinion shaft 17 taking care of this resilient engagement of the extension 102 of the pivotable and axially displaceable arm 1 or of the support frame 66 against the control template 100. The actual movement of the components is also in this case exactly determined by the slip-free connection between the toothed rod 15 or 73 and the potentiometer.

The support element 22 illustrated in FIG. 3, along with the components disposed thereon, is used for both embodiments. Where the grinding wheels are stationarily disposed in a housing, the support element is disposed on or in this housing. Where the grinding wheels are adjustably disposed on a mounting base, as in the case of the mounting base 56 in FIG. 4, the support element 22 is disposed on the mounting base.

It is within the scope of the present invention, and merely constitutes a kinematic reversal, to dispose the support element 22 on the bridge 10 or on the support frame 66, and the toothed rod on the housing or on the mounting base 56. However, such an embodiment would not be as favorable as the previous two described embodiments to the extent that in this case the support element along with its components increases the mass of the elements that have to be displaced, whereas with the illustrated embodiments the displaceable mass is constituted by merely the toothed rack 15 or 73, with this mass being considerably less than the mass of the support element 22 with all of its components.

The present invention is, of course, in no way restricted to the specific disclosure of the specification and drawings, but also encompasses any modifications within the scope of the appended claims.

What we claim is:

1. A machine for grinding the edges of a lens, with said machine including a machine housing that has a longitudinal direction and in which are mounted a set of different grinding wheels for rough and finish grinding of lenses, said machine further comprising:

a horizontal shaft that is mounted on said housing in such a way that it is parallel to, and displaceable in, said longitudinal direction thereof;

an arm that carries said lens and is pivotably mounted on said horizontal shaft in such a way as to be displaceable in said longitudinal direction of said housing, along with said horizontal shaft, at right angles to its direction of pivot;

a bridge that is mounted in said housing in such a way as to be displaceable in said longitudinal direction thereof, with said bridge being connected to said horizontal shaft in such a way that the latter is pivotable relative thereto yet is displaceable along with said bridge, thus also displacing said arm;

a support element provided on said housing;

a motor specifically mounted on said support element;

a coupling also specifically mounted on said support element and operatively connected to said motor;

a toothed-wheel gearing for effecting said longitudinal displacement of said bridge, and hence of said horizontal shaft and said arm, with said gearing including a toothed rack disposed on said bridge, and a cooperating pinion that is mounted on said support element and is operatively connected to said coupling; and a rotary potentiometer that is mounted also specifically on said support element and is in engagement with said gearing, whereby said motor, said coupling, said rotary potentiometer, and said pinion are all coaxially disposed in common on said support element as a unitary arrangement.

2. A machine according to claim 1, which includes a fixed guide rod that is mounted on said machine housing and extends parallel to said horizontal shaft, with said bridge being guided on said guide rod; and in which said toothed rack is disposed on a portion of said bridge remote from said horizontal shaft, with said guide rod being disposed between the latter and said toothed rack.

3. A machine according to claim 1, which includes a cam against which said arm rests.

4. A machine according to claim 1, but kinematically reversed, whereby said support element, along with its components, is provided on said bridge, and said toothed rack is disposed on said housing.

5. A machine for grinding the edges of a lens, said machine comprising:

a bridge-like support frame that is movable in two horizontal coordinates;

a first motor mounted on said support frame and having a shaft on which is mounted a set of different grinding wheels for rough and finish grinding of lenses;

a movable mounting base for supporting said support frame in such a way that said aforementioned movement thereof is possible; and a toothed rack that is provided on said support frame and meshes with a pinion that is mounted on said mounting base in common as a unitary arrangement coaxially respectively along with a drive motor, a rotary potentiometer, and a coupling that is disposed between said drive motor and said pinion.

6. A machine according to claim 5, in which said support frame includes a central portion that is guided on said mounting base, and two end portions, one of which carries said toothed rack, and the other of which carries said first motor with said shaft for said grinding wheels.

7. A machine according to claim 5, which includes a cam against which said support frame rests.

8. A machine according to claim 5, but kinematically reversed, with a support element on which said drive motor, said potentiometer, said coupling, and said pinion are disposed, whereby said support element, along with its components, is provided on said support frame, and said toothed rack is provided on said mounting base.

9. A machine for grinding the edges of a lens via a set of grinding wheels for rough and finish grinding of lenses, said machine comprising:

a machine housing;

means mounted in said housing for holding either said lens or said set of grinding wheels and movable in two directions relative to the other thereof, with said two directions being at right angles to one another;

a support element provided on said housing; and a toothed-wheel gearing for effecting movement of said holding means, and hence of said lens or set of grinding wheels disposed thereon, in one of said two directions, with said gearing including a toothed rack on said holding means, and a driven pinion on said support element, with said pinion being mounted on said support element in common as a unitary arrangement coaxially respectively along with a drive motor, a coupling, and a rotary potentiometer.

* * * * *